US005341829A

United States Patent [19]

Hsiao et al.

[11] Patent Number: 5,341,829

[45] Date of Patent: Aug. 30, 1994

[54] ADJUSTABLE FOREARM CRUTCHES

[76] Inventors: Fang-Jung Hsiao, No. 380-8, Hsinchuotze, Lung-Chiang Li, Pu Tai, Chia Yi Hsien; Ming-Lung Hsieh, No. 208, Chung Cheng Rd., Jen Te Li, Hsueh Chia Chen, Tainan Hsien, both of Taiwan

[21] Appl. No.: 93,625

[22] Filed: Jul. 20, 1993

[51] Int. Cl.[5] ..... A61H 3/02

[52] U.S. Cl. ..... 135/68; 135/72; 403/108

[58] Field of Search ..... 135/68, 69, 72, 75, 135/910; 403/105, 106, 108, 261, 331, 375, 384

[56] References Cited

U.S. PATENT DOCUMENTS

| | | | |
|---|---|---|---|
| 1,035,760 | 8/1912 | Walton | 135/72 X |
| 1,400,600 | 12/1921 | Glowacki | 135/72 |
| 3,251,371 | 5/1966 | Croker | 135/910 X |
| 4,865,065 | 9/1989 | Chen | 135/68 X |

*Primary Examiner*—Carl D. Friedman
*Assistant Examiner*—Kevin D. Wilkens
*Attorney, Agent, or Firm*—Browdy and Neimark

[57] ABSTRACT

An adjustable forearm crutch, wherein the fork support is formed with a central reinforcing rib for increasing the bending-resistant strength of the fork support, the reinforcing rib and the adjacent wall of the fork support defining a recess. After the fork support is molded, the recess can serve as a standard face for the processing procedure so that when punching holes on the fork support, no deflection will take place. The fork support and fixing tube being inserted in through holes of a sleeve member so that the waste chips and water produced when processing the fork support can be easily removed. The through hole of the sleeve member for receiving the fixing tube is formed with an annular groove which provides a resilient clamping effect, the end of which is cut into several equal sections for providing resilient clamping effect, so that the adjusting tube is firmly supported at two points without loosening or swinging. When the adjusting tube is installed into the fixing tube, the fastening member of the adjusting tube is guided and compressed by an arched face of the sleeve member to facilitate the installation of the adjusting tube into the fixing tube.

3 Claims, 9 Drawing Sheets

A-A Section

B-B Section

ADJUSTABLE FOREARM CRUTCHES

BACKGROUND OF THE INVENTION

The present invention relates to an improved crutch structure, wherein the fork support is formed with a central reinforcing rib for increasing the bending-resistant strength of the fork support. The reinforcing rib and the adjacent wall of the fork support define a recess, whereby after the fork support is molded the recess can serve as a standard face for the processing procedure so that when punching holes on the fork support, no deflection will take place. The fork support and fixing tube are inserted in through holes of the sleeve member so that the waste chips and water produced when processing the fork support can be easily removed. The through hole of the sleeve member for receiving the fixing tube is formed with an annular groove which provides a resilient clamping effect. The end of the adjusting tube is fitted with a tube plug one end of which is cut into several equal sections for providing resilient clamping effect, so that the adjusting tube is firmly supported at two points without loosening or swinging, and when the adjusting tube is installed into the fixing tube, the fastening member of the adjusting tube is guided and compressed by an arched face of the sleeve member to facilitate the installation of the adjusting tube into the fixing tube. Conventional crutch structure is constructed as shown in FIG. 1, comprising an armpit section 11, a fork support 12, a grip 13, a fixing tube 14, a sleeve member 15 and an adjusting tube 16, wherein the relationship between the fixing tube 14, sleeve member 15 and the adjusting tube 16 is as shown in FIGS. 2 and 3. The cross-section of the fixing tube 14 and the fork support 12 is shown by A—A sectional view, wherein the fixing tube 14 has a substantially circular cross-section and two lateral projections. The top face of the projection is arched for closely abutting against the fork support 12. The fork support 12 and the fixing tube 14 is locked together by rivets 21. The fixing tube 14 is inserted into the sleeve member 15 while the fork support 12 is not inserted thereinto. An end plug 121 is fitted into each end of the fork support 12. A resilient fastening member 161 is disposed at the top end of the adjusting tube 16, whereby when the adjusting tube 16 is inserted through a through hole of the sleeve member 15 into the fixing tube 14, the fastening member 161 is aligned with the fixing holes 141 punched on the wall of the fixing tube to achieve an extensibly adjusting effect. The outer diameter of the adjusting tube 16 corresponding to the inner diameter of the sleeve member 15, allowing the adjusting tube 16 to easily slide therewithin, while the inner diameter of the fixing tube 14 is slightly larger than the outer diameter of the adjusting tube 16 so as to avoid the damage thereof due to the friction therebetween. Further referring to FIG. 4, the grip 13 is formed by a central shaft rod 131 and an outer sponge sleeve 132. Two ends of the shaft rod 131 are arch-shaped corresponding to the fork support 12. After the shaft rod 131 is fitted between the fork support 12, a screw 133 is extended therethrough to secure with a butterflynut 134.

Several shortcomings exist in the above arrangement as follows:

1. After the fork support 12 is bent into the necessary shape, the same must be punched with multiple holes (as shown by the holes 0, P, Q, etc. of FIG. 8). Because the fork support has circular cross-section and is likely to roll as shown in FIG. 6, the fork support 12 can be hardly stably secured on a standard surface so that when punching the holes thereon, the holes often are not located in the same central line. Therefore, the installation often cannot be accurately performed and revision or further processing is required for completing the installation. As a result, the time and labor are wasted.

2. As shown in FIG. 2, the arched faces of the projections of the fixing tube 14 abut against the wall of the fork support 12 and the fixing tube 14 is secured with the fork support 12 by rivet 21. However, the test reveals that when the crutch is vertically placed on the ground and suffers a force at the armpit section 11, the crutch will be bent at a portion E and broken at the rivet position as shown in FIG. 8 and photogragh 1.

3. On the other hand, when the crutch is placed at a 45 degrees inclined position with the armpit section 11 fixed, in case a force is exerted on the grip 13, the crutch will be distorted and broken at the hole R of the fork support 12 near the grip 13 as shown in FIG. 9 and photogragh 2.

4. The fork support 12 is not inserted into the sleeve member 15 and the ends of the fork support 12 are plugged with end plugs 121 so that the waste chips and water produced when processing the fork support 12 cannot be removed therefrom and affect the quality of the crutch or corride the inner wall of the fork support 12 and thus the safety of the user cannot be ensured.

5. The shaft rod 131 of the grip 13 has a small long central hole. When extending the screw 133 through the fixing hole of the fork support 12 and the long central hole of the shaft rod, it is difficult to align these two holes. Moreover, the central hole of the shaft rod is apt to disformed by external force and often needs to be redrilled before installation.

6. The conventional crutch cannot provide any warning or locating effect at night so that the safety of the crutch-user cannot be ensured at night or the user cannot easily locate the crutch in a dark place.

7. Bacause the inner diameter of the fixing tube 12 is slightly larger than the outer diameter of the adjusting tube 16, a gap exists therebetween and the adjusting tube 16 cannot closely slide within the fixing tube 12 without swinging. This shortens the using life of the adjusting tube 16 and the user is in danger of falling. Moreover, although the adjusting tube 16 is closely fitted within the sleeve member 15, a long period of abrasion therebetween will make the clearance increased and cause a loosening condition.

SUMMARY OF THE INVENTION

It is therefore a primary object of the present invention to provide an improved crutch structure, wherein the fork support is formed recesses suitable to closely receive the projections of the fixing tube and the fork support has a central reinforcing rib for increasing the bending-resistant strength of the fork support and making the fork support not so easy to deform, break or damage.

It is a further object of the present invention to provide the above crutch structure, wherein the recesses of the fork support can serve as a standard surface for processing, making the fork support easy to be fixed without deflection when punching holes thereon.

It is still a further object of the present invention to provide the above crutch structure, wherein the recesses of the fork support can guide the grip when adjusting the position thereof to facilitate the operation of aligning the holes and locking the grip.

It is still a further object of the present invention to provide the above crutch structure, wherein the fork support are inserted into the through holes of the sleeve member so that the waste chips and water produced when processing the fork support can be easily removed.

It is still a further object of the present invention to provide the above crutch structure, wherein the recesses of the fork support can be disposed with reflecting or fluourescent strips so that the crutch structure can provide a warning effect of easily locating effect at night.

It is still a further object of the present invention to provide the above crutch structure, wherein the through hole of the sleeve member for receiving the fixing tube is formed with an annular groove which provides a resilient clamping effect and the end of the adjusting tube is fitted with a tube plug one end of which is cut into several equal sections for providing resilient clamping effect, so that the adjusting tube is firmly supported at two points without loosening or swinging.

It is still a further object of the present invention to provide the above crutch structure, wherein when the adjusting tube is installed into the fixing tube, the fastening member of the adjusting tube is guided and compressed by an arched face of the sleeve member to facilitate the installation of the adjusting tube into the fixing tube.

The present invention can be best understood through the following description and accompanying drawings, wherein:

DETAILED DESCRIPTION OF THE PREFERRED EMBODIMENT

Figure 10:
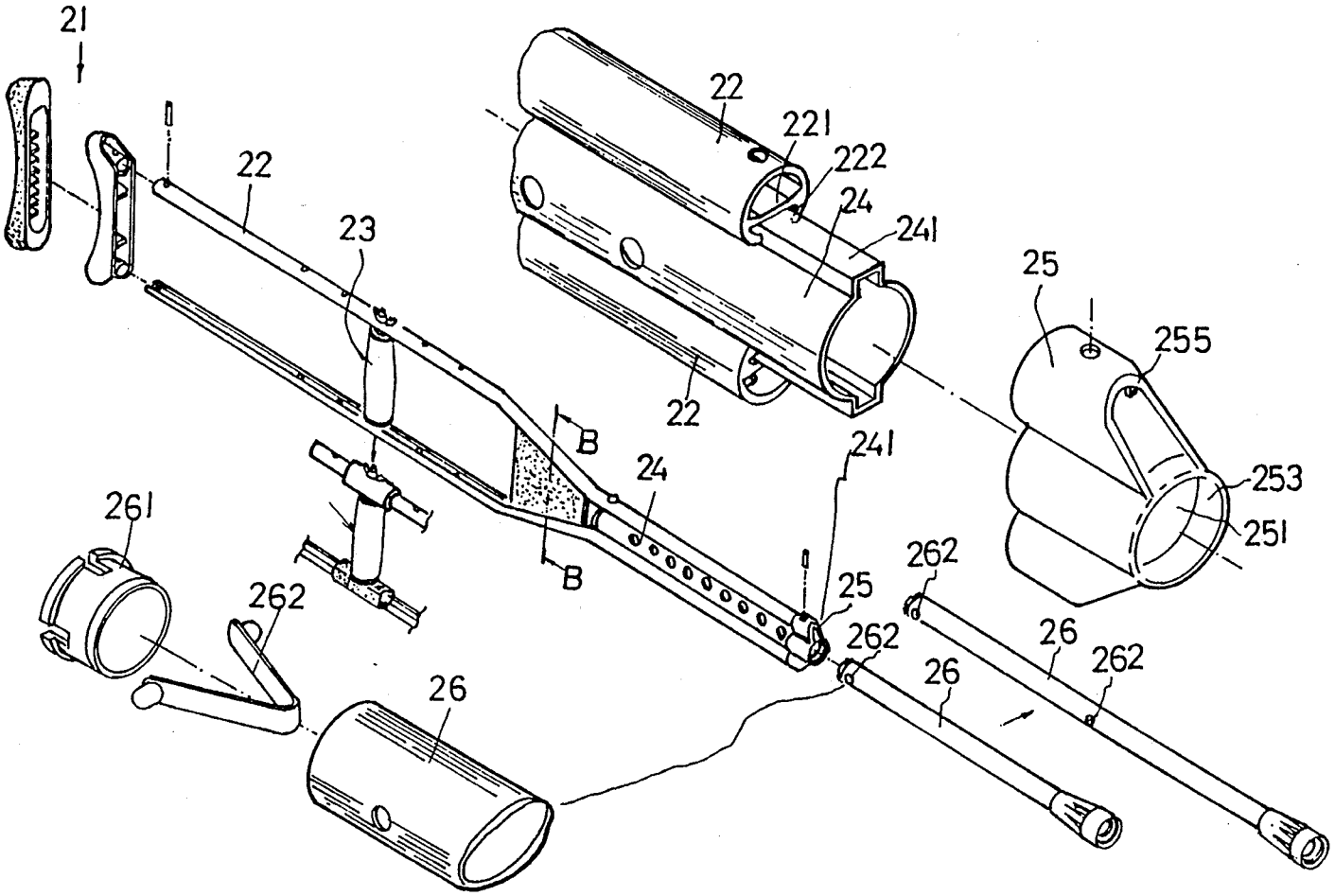
FIG. 10 is a perspective exploded view of the present invention.
Figure 11B:
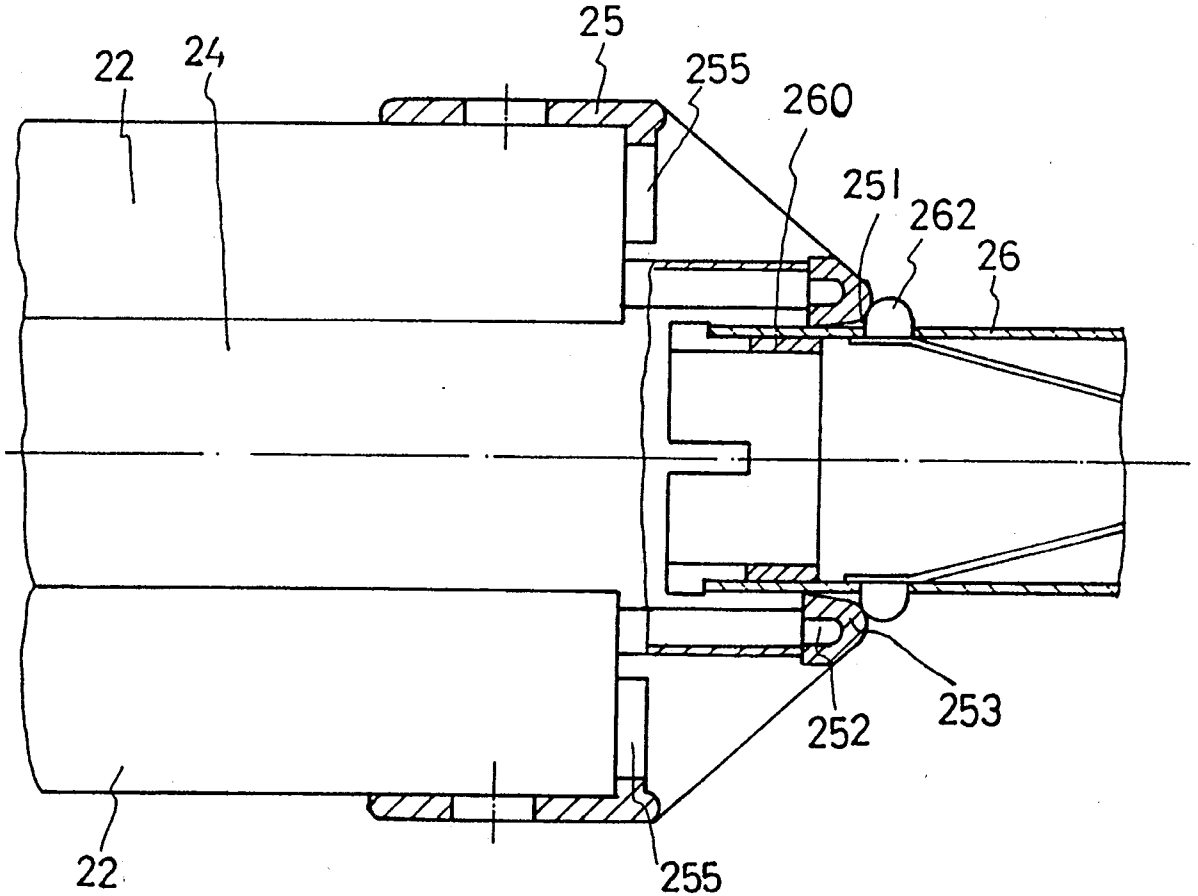
FIGS. 11A and 11B are a sectional views of the sleeve member of the present invention.
Figure 12A:
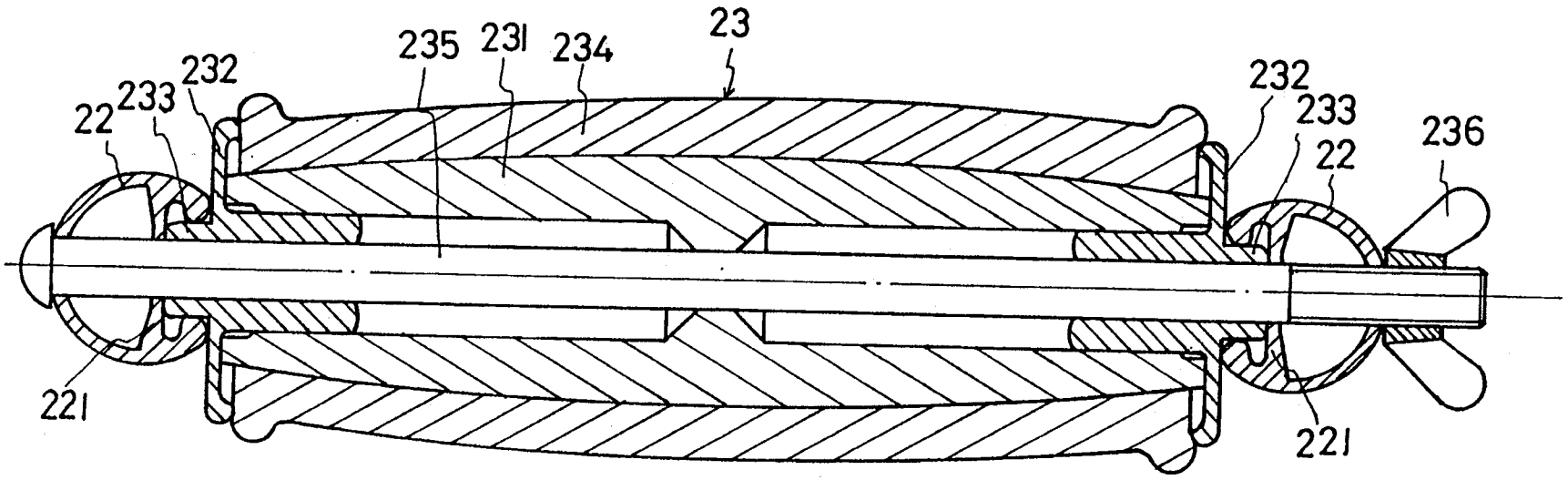
FIG. 12A is a sectional view of one embodiment of the grip of the present invention.
Figure 12B:
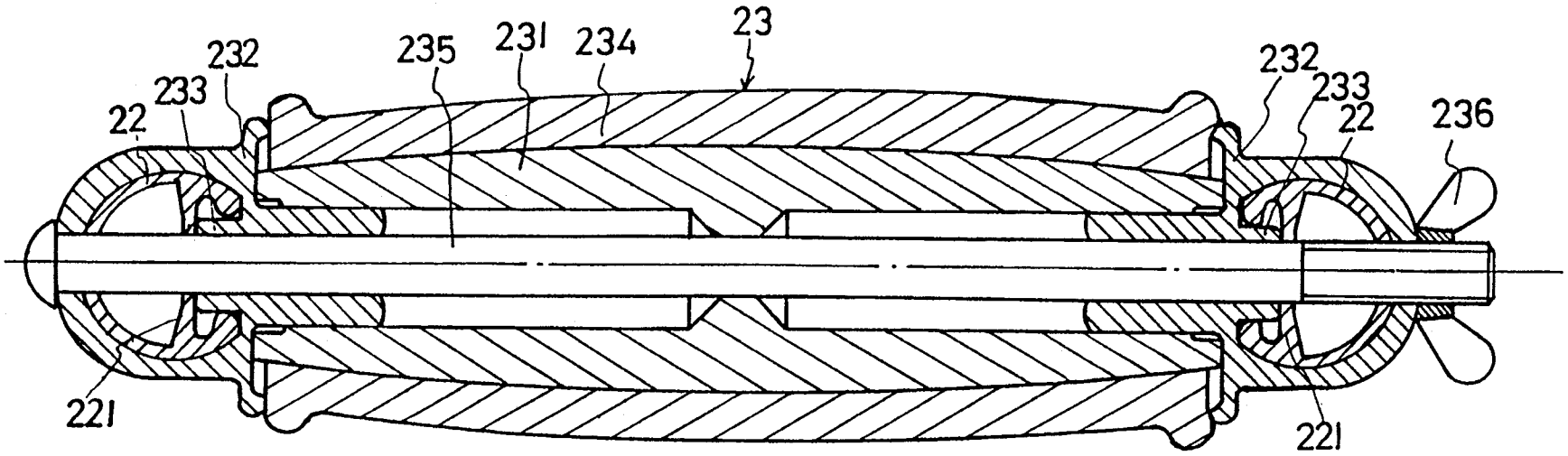
FIG. 12B is a sectional view of another embodiment of the grip of the present invention.

Please refer to FIG. 10. The crutch of the present invention is composed of an armpit section 21, a fork support 22, a grip 23, a fixing tube 24, a sleeve member 25 and an adjusting tube 26, wherein the fork support 22 is formed with a central reinforcing rib 221 and has a C-shaped cross-section. The reinforcing rib 221 and the adjacent walls of fork support 22 define a recess 222 for receiving a projecting section 241 of the fixing tube 24. The fork support 22 and the fixing tube 24 are respectively inserted in through holes of the sleeve member 25 (as shown in FIG. 11B). A stop flange 255 is formed in the through holes of the sleeve member 25 for fixing and restricting the fork support 22 from extending outside the sleeve member 25. Please now refer to FIG. 124. The grip 23 has a central shaft rod 231 two ends of which are plugged with two plug members 232. Each of the plug member 232 has an outer guide section 233 suitable to be slidably fitted in the recess 222 of the fork support 22. The shaft rod 231 is sleeved by a sponge sleeve 234. A screw 235 extends through the shaft rod 231 to secure with a butterfly nut 236. Alternatively, the plug member 232 can be shaped as shown in FIG. 12B, wherein the plug member 232 has a guide hole 2331 corresponding to the fork support 22 for receiving the same in addition to the guide section 233. The plug member 232 can be painted with or added with fluorescent agent.

Figure 11A:
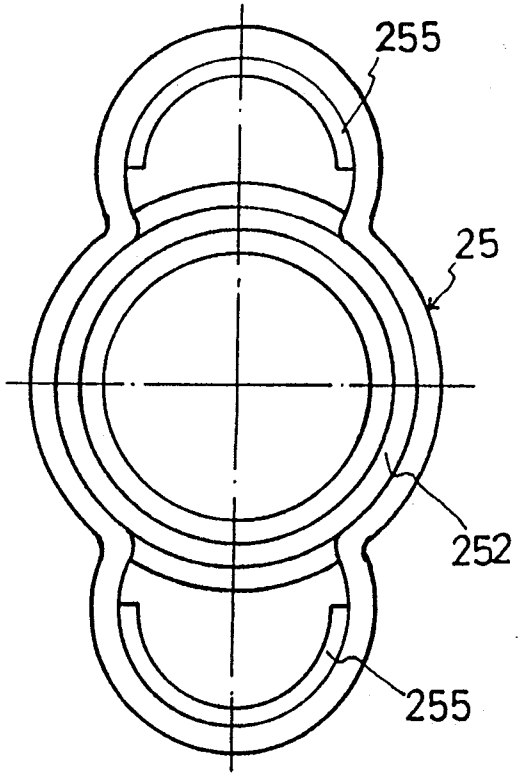

Please further refer to FIGS. 10 and 11A and 11B. The through hole 251 of the sleeve member 25 for receiving the fixing tube 24 is formed with an annular groove 252 which provides a resilient clamping effect. An arched face 253 is formed on inner side of the end of the through hole 251. The end of the adjusting tube 26 is fitted with a tube plug 260 one end of which is cut into several equal sections for providing resilient clamping effect, whereby when the adjusting tube 26 is inserted into the fixing tube 24, the cut end of the tube plug 260 of the adjusting tube 26 resiliently abuts against the inner wall of the fixing tube 24 and the annular groove 252 of the through hole 251 of the sleeve member 25 resiliently clamps the adjusting tube 26 so that the adjusting tube 26 is firmly supported at an upper and a lower points.

Moreover, the adjusting tube 26 can be extended as shown in FIG. 10, wherein the end and the middle portion of the adjusting tube 26 can be both provided with fastening members 262, whereby when using the middle fastening member 262, the length of the crutch can be adjusted to 1540 mm, while when using the end fastening member 262, the length thereof can be adjusted up to 1740 mm. Therefore, the length of the adjusting tube 26 is adjustable so as to meet the requirements of different users with different heights.

The above arrangement achieves the following effects:

1. The recesses of the fork support can be fitted with the projecting sections of the fixing tube and the fork support has a central reinforcing rib so that the bending-resistant strength of the fork support is increased, making the fork support not so easy to be disformed, cracked or damaged.

Figure 4:
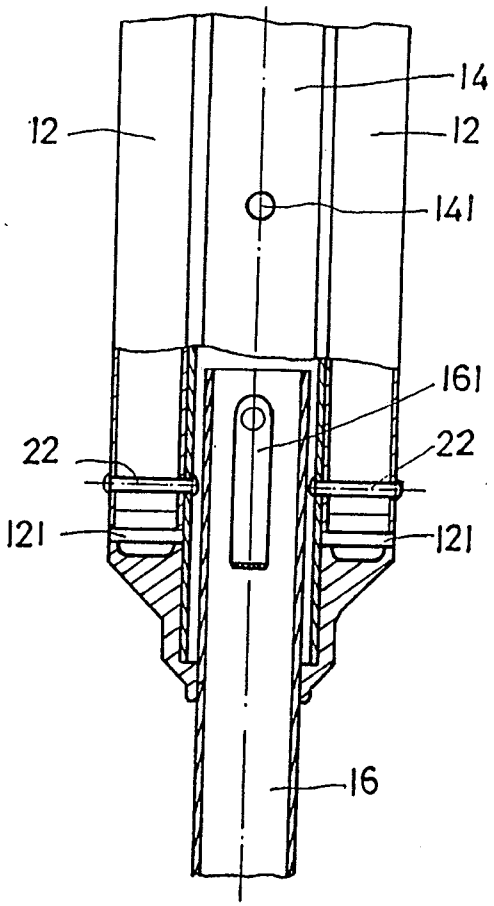
Prior Art FIG. 4
FIG. 4 is a longitudinal sectional view according to FIG. 1.
Figure 2:
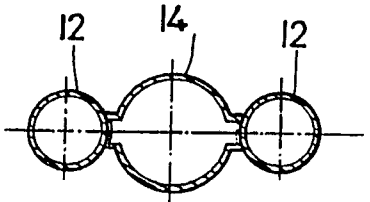
Prior Art FIG. 2
FIG. 2 is a cross-sectional view according to FIG. 1.
Figure 3:
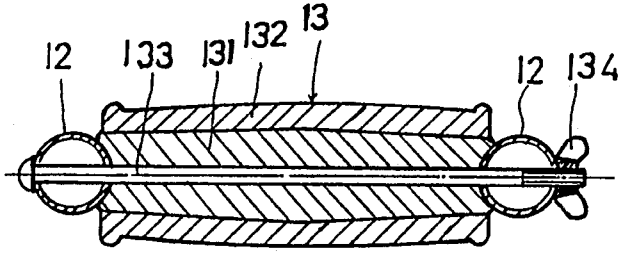
Prior Art FIG. 3
FIG. 3 is another cross-sectional view according to FIG. 1.
Figure 1:
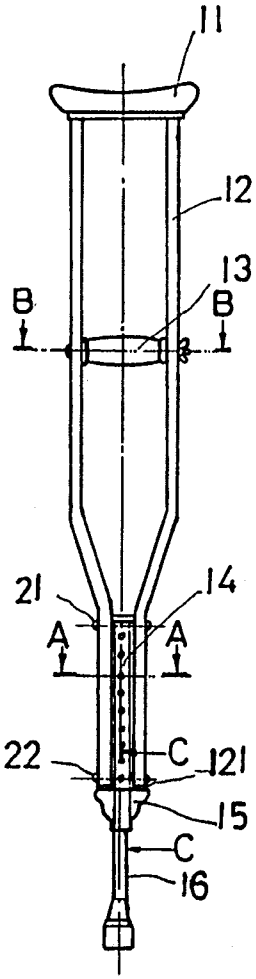
Prior Art FIG. 1
FIG. 1 shows a conventional crutch structure.
Figure 5:
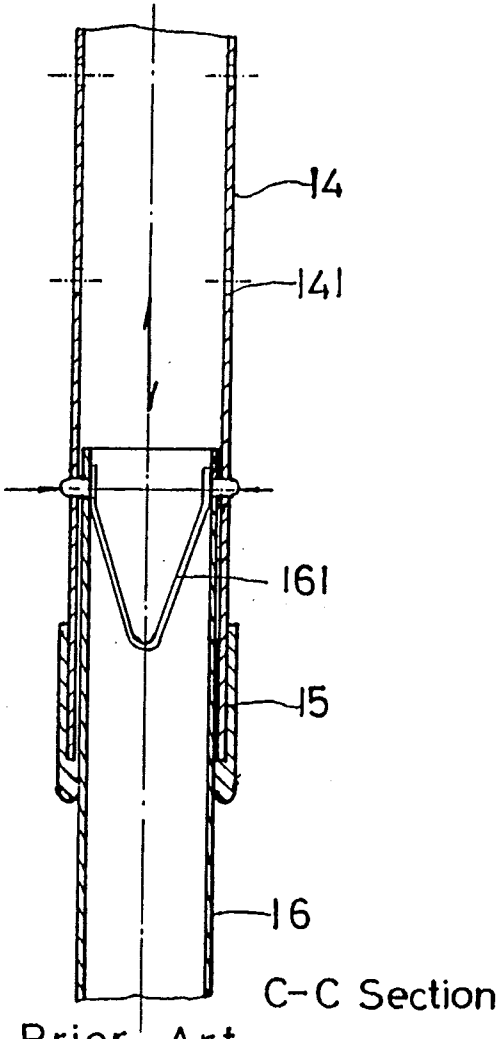
Prior Art FIG.5
FIG. 5 is another longitudinal sectional view according to FIG. 1.
Figure 7:
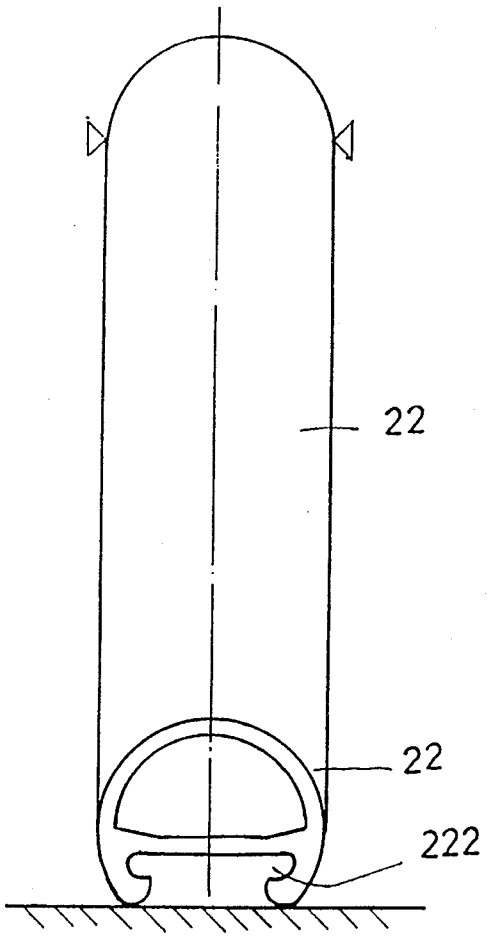
Prior Art FIG. 7
FIG. 7 shows the hole-punching processing of the fork support of the crutch structure of the present invention.
Figure 6:
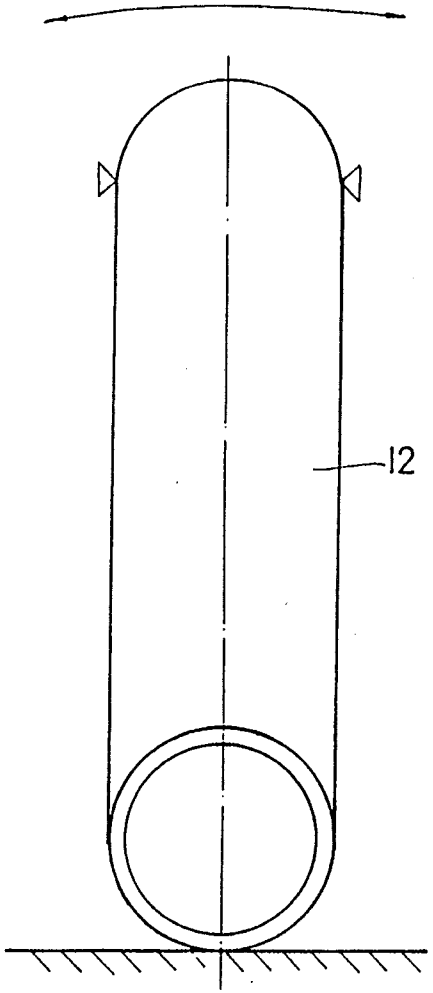
Prior Art FIG. 6
FIG. 6 shows the hole-punching processing of the fork support of the conventional crutch structure.
Figure 9:
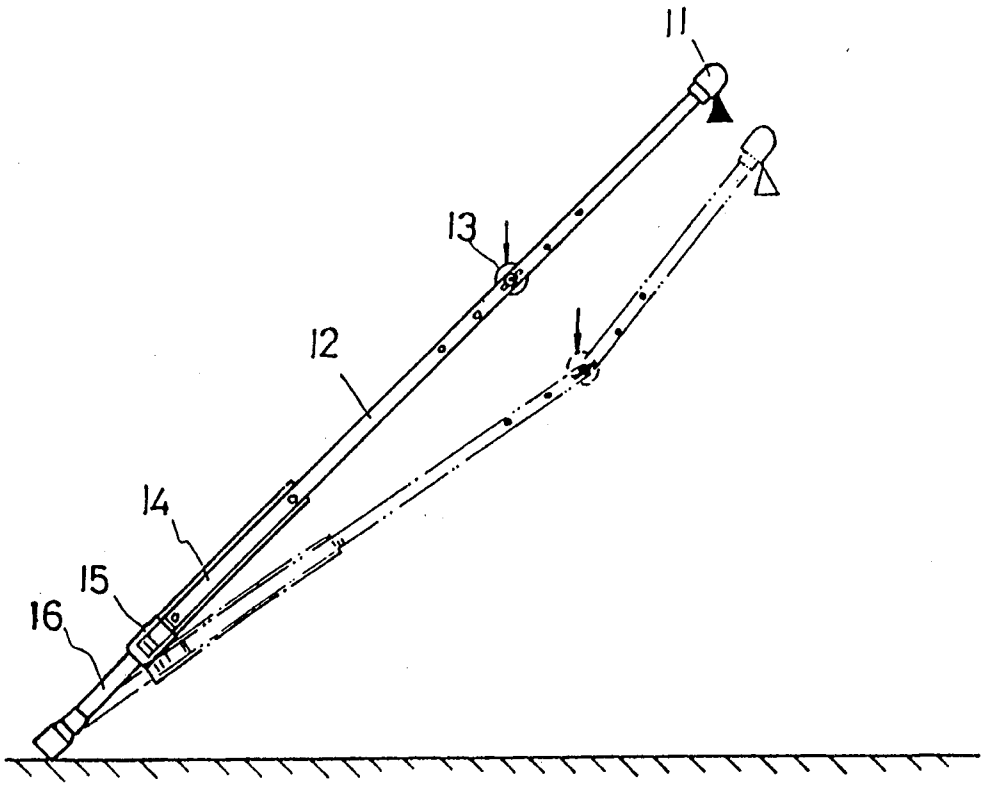
Prior Art FIG.9
FIG. 9 shows a result of a force-suffering test of the conventional crutch structure in an inclined state.
Figure 8:
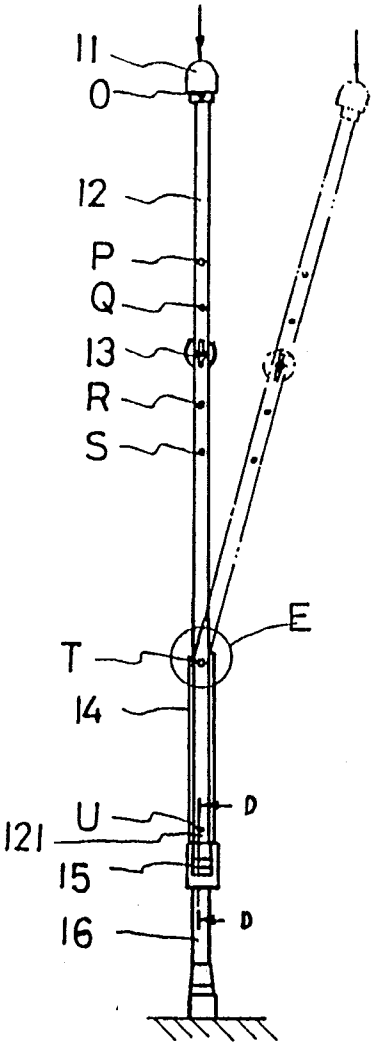
Prior Art FIG.8
FIG. 8 shows a result of a force-suffering test of the conventional crutch structure in a vertical state.

2. The recesses of the fork support serve as a fixing standard face for processing. The recesses make the fork support easy to be fixed and supported when punching holes thereon, as shown in FIG. 7 and the holes can be thus punched in the same central line without deflection.

3. The recesses of the fork support serve as a guide when adjusting the position of the grip. Two ends of the grip are disposed with plug members having guiding sections so as to facilitate the operation of aligning the holes, locking, etc.

4. The hole of the sleeve member for receiving the fork support is a through hole so that the waste chips and water produced when processing the fork support can be easily removed.

Figure 13A:
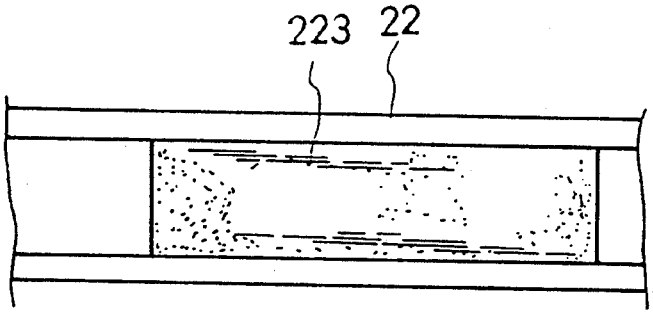
FIG. 13A and 13B are sectional views of the reflecting or fluorescent strips of the crutch structure of the present invention.
Figure 13B:
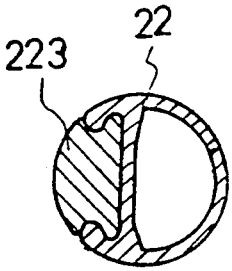
Figure 13C:
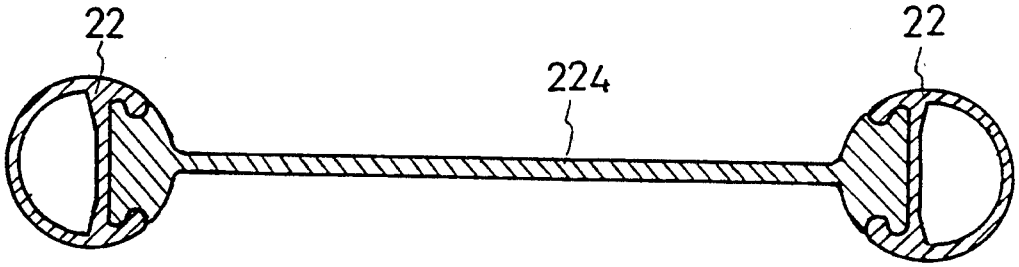
FIG. 13C is a cross sectional view along section line B—B of FIG. 10.

5. The recesses of the fork support can be disposed with reflecting strips or fluorescent strips. Alternatively, a reflecting or fluorescent plate can be disposed at the triangular section of the fork support or the outer surface of the plug members of the grip can be painted with or added with fluorescent agent so that the four light points can be shown at night at the two ends of the grip, making the user easily locate the crutch at night or providing a reflecting warning effect for safety of the user (as shown in FIG. 13).

6. When the adjusting tube is inserted into the sleeve member through the through hole thereof, the annular groove of the sleeve member resiliently clamps the adjusting tube. When the tube plug of the adjusting tube is installed into the fixing tube, the tube plug is guided by the arched face of the sleeve member to make the fastening member located at the end of the adjusting tube to be compressed and retracted. Therefore, no pressing movement is required for inserting the adjusting tube into the fixing tube. As a result, the installation of the adjusting tube into the fixing tube can be quickly and easily made to save labor and time.

7. Because one end of the tube plug of the adjusting tube is cut apart, when the adjusting tube is inserted into the fixing tube, the tube plug can resiliently abut against the inner wall of the fixing tube. In addition, when the adjusting tube is slided in the fixing tube, the annular groove of the sleeve member resiliently clamps the wall of the adjusting tube so that the adjusting tube is firmly supported at two point without loosening or swinging.

8. The adjusting tube can be extended and respectively has two fastening members at the end and middle portion so that the length of the crutch can be adjusted within a greater range to suit different users with different heights.

What is claimed is:

1. An adjustable forearm crutch comprising:

an armpit section, a fork support, a grip a fixing tube having a projecting section, a sleeve member having a first through hole and second through holes and an adjusting tube, wherein said fork support has a central reinforcing rib and a C-shaped cross-section, said reinforcing rib and adjacent walls of said fork support defining a recess for receiving said projecting section of said fixing tube, said fork support and fixing tube being respectively inserted in said second through holes of said sleeve member, a stop flange being formed in said second through holes of said sleeve member for fixing and restricting said fork support from extending outside said sleeve member, said grip having a central shaft rod two ends of which are plugged with two plug member, each of said plug member having an outer guide section suitable to be slidably fitted in said recess of said fork support, said first through hole of said sleeve member for receiving said fixing tube being formed with an annular groove around an entrance end which provides a resilient clamping effect, an arched face being formed on an inner side of said entrance end of said first through hole, an entrance end of said adjusting tube being fitted with a tube plug one end of which is cut into several equal sections to provide a resilient clamping effect when inserted in said first through hole.

2. A crutch structure as claimed in claim 1, wherein said recesses of said fork support are disposed with reflecting or fluorescent strip or plate so as to provide a warning effect for safety or facilitate the location of the crutch at night.

3. A crutch structure as claimed in claim 1, wherein said adjusting tube is extendable by fastening members respectively located at an end and a middle section thereof.

* * * * *